US006710236B2

(12) United States Patent
Takegawa

(10) Patent No.: US 6,710,236 B2
(45) Date of Patent: Mar. 23, 2004

(54) DRUM HOLDER FOR DRUM STAND

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 10/156,230

(22) Filed: May 29, 2002

(65) Prior Publication Data

US 2003/0221540 A1 Dec. 4, 2003

(51) Int. Cl.[7] ..... G10D 13/02
(52) U.S. Cl. ..... 84/421
(58) Field of Search ..... 84/421

(56) References Cited

U.S. PATENT DOCUMENTS

| | | | | |
|---|---|---|---|---|
| 1,059,192 A | | 4/1913 | Mills | |
| 1,837,637 A | | 12/1931 | Walberg | |
| 2,245,883 A | | 6/1941 | Walberg | |
| 3,173,642 A | | 3/1965 | Greenspan | |
| 3,405,587 A | | 10/1968 | Meazzi et al. | |
| 3,742,806 A | * | 7/1973 | Zalmer | 84/422.1 |
| 4,274,322 A | * | 6/1981 | Cordes | 84/422.3 |
| 4,333,378 A | | 6/1982 | Hrdlicka | |
| 5,331,878 A | | 7/1994 | Kurosaki | |
| 5,362,025 A | | 11/1994 | Trom et al. | |
| 5,467,680 A | | 11/1995 | Kurosaki | |
| 5,542,639 A | | 8/1996 | Wixey et al. | |
| 5,881,981 A | | 3/1999 | Yanagisawa | |
| 6,040,514 A | | 3/2000 | Liao | |
| 6,215,054 B1 | | 4/2001 | Woodhouse et al. | |

* cited by examiner

*Primary Examiner*—Kimberly Lockett
(74) *Attorney, Agent, or Firm*—Liniak, Berenato & White

(57) ABSTRACT

A stand for supporting musical drums includes a drum holder assembly having at least three spaced radial arms that may be adjusted to accommodate a variety of sizes of the drums. Each of the radial arms of the drum holder of the present invention includes a support member, and an adjustable sleeve member. The adjustable sleeve member is provided at its distal end with a vibration-isolating member formed of an elastomeric material and adapted to engage the drum and effectively isolate vibrations emanating from the drum during performance. The vibration-isolating member has a base portion and a grip portion. The grip portion is provided with a hollow portion formed therethrough that deforms when vibrations or other loads are transmitted to the radial arm through the grip member from the drum, thereby effectively isolating the drum from the radial arms.

23 Claims, 3 Drawing Sheets

DRUM HOLDER FOR DRUM STAND

BACKGROUND OF THE INVENTION

1. Field of the Invention

The present invention relates to a drum stand, and more particularly to an improved adjustable drum holder for drum stands provided with grip members that would effectively isolate vibrations of a drum during performance.

2. Description of the Prior Art

A drum stand is generally made up of an upright center post, radial arms mounted atop the center post via a conventional clamping mechanism, such as ball-type, gear-type, etc., and three legs connected to the lower end of the center post in a tripod arrangement.

Typically, three or four radial arms used for holding a drum overhead are arranged atop the clamping mechanism with 120 or 90 degrees center angle intervals. However, the existing devices to adjust the length of the radial arms to accommodate drums of various sizes, are complex and cumbersome to operate.

The radial arms are typically provided at their distal ends with elastic covers to isolate vibrations during performance of the drum. However, the current elastic covers of the radial arms of the drum stands are not sufficiently effective in isolating vibrations of the drum.

Therefore, there is a need for a drum stand having easily operable adjustable radial arms and provided with grip members at their distal ends that would effectively isolate vibrations of the drum during performance.

SUMMARY OF THE INVENTION

The present invention provides a stand for supporting an instrument, such as drum or the like. The stand of the present invention includes a drum holder assembly having at least three spaced radial arms that may be adjusted to accommodate a variety of sizes of drums with firmness and rigidity, and with ease and convenience, and in a manner such that the drum will not vibrate or bounce when being played.

Each of the radial arms of the drum holder of the present invention includes a support member, and an adjustable sleeve member. The adjustable sleeve member is slidably mounted to a distal end portion of each of the support members for adjusting an effective length of the radial arms in order to accommodate drums of various sizes. Each of the adjustable sleeve members is provided at its distal end with a vibration-isolating member adapted to engage an outer cylindrical surface of the drum and to effectively isolate and isolate vibrations emanating from the drum during performance.

The vibration-isolating member of the present invention has a base portion and a grip portion extending substantially vertically from the base portion. The base portion is fixed to the distal end of each of the adjustable sleeve members. The grip portion of the vibration-isolating member has a hollow portion formed therethrough that deforms when vibrations or other loads are transmitted to the radial arm through the grip member from the drum. Preferably, a plurality of elastic ribs (or corrugations) are formed on an outer surface of the vibration-isolating member engaging the drum to inhibit the drum from slipping when placed on the vibration-isolating member.

The vibration-isolating member is preferably made of a soft elastomeric compound. The combination of a soft elastomeric compound and the hollow portion of the vibration-isolating member significantly improves the performance of musical drums. The vibration-isolating member is also preferably homogeneously formed as a unitary body, thus alleviating the cost of assembling multiple components and simplifying its manufacture.

When vibrations or other loads are transmitted to the vibration-isolating member from the drum, the grip portion deforms and flattens, thereby isolating the load and effectively isolating the drum from the radial arms. Thus, quality of sound of the drum significantly improves.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiment of the present invention will now be described with the reference to accompanying drawings.

Figure 1:
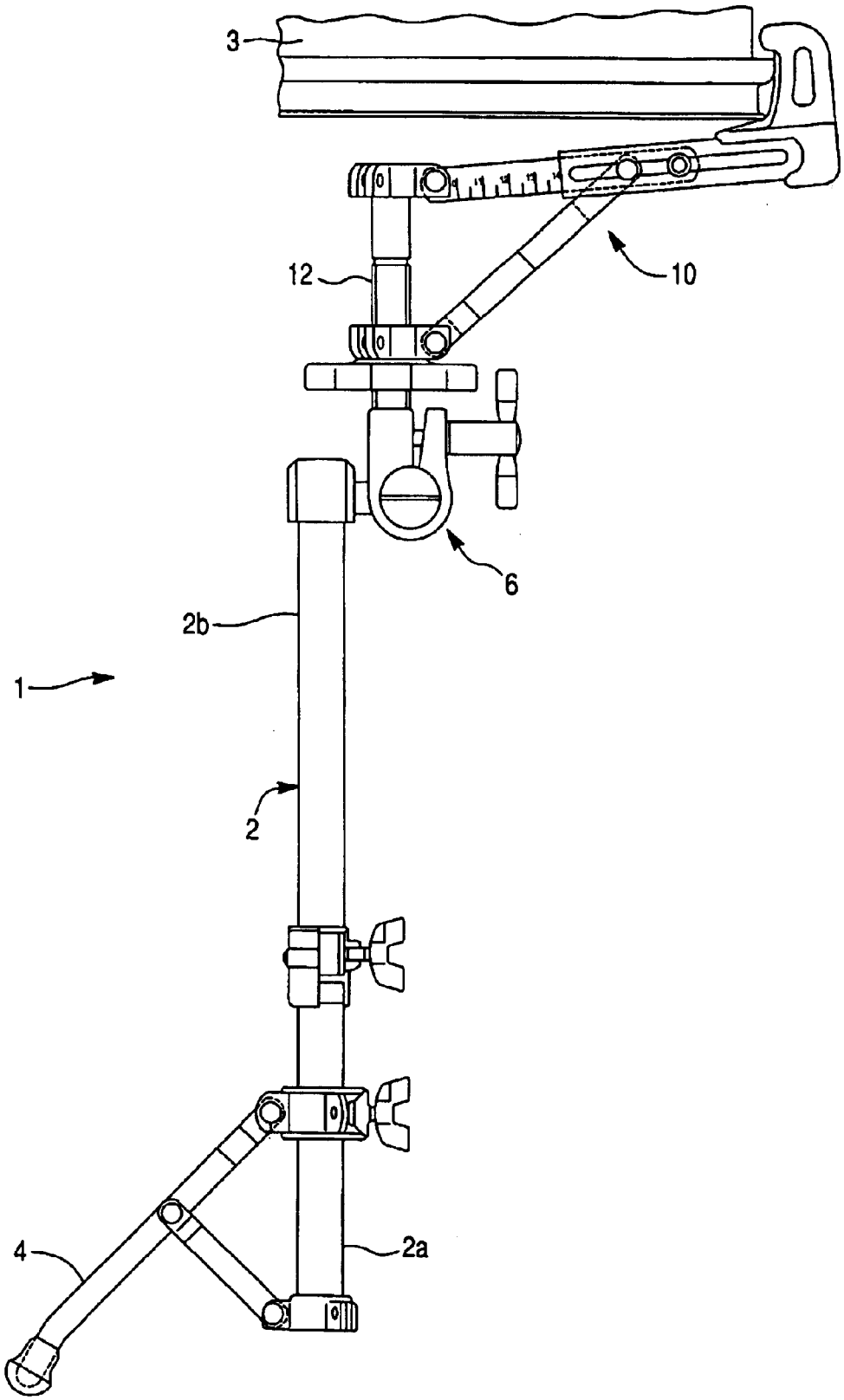
FIG. 1 is an elevation view of a floor-standing drum stand in accordance with the preferred embodiment of the present invention.

As illustrated in FIG. 1, a floor-standing drum stand 1 in accordance with the present invention is provided for supporting a musical instrument, such as drum 3 or the like. The drum stand 1 includes an upright post 2 that is supported on a floor by three tripod type legs 4 provided at a lower end portion 2*a* thereof. An upper end portion 2*b* of the upright post 2 is adapted to support a drum holder assembly 10. A drum holder adjusting device in the form of a clamping mechanism 6 of a known construction is mounted at the upper end portion 2*b* of the upright post 2 in order to firmly hold a lower end of a holder shaft 12 of the drum holder assembly 10. By proper manual operation on the clamping mechanism 6, the angular position of a holder shaft 12 with respect to the upright post 2 can be adjusted as required. The clamping mechanism may be of any appropriate type well known to those skilled in the art, such as friction-type, gear-type, ball-type, etc.

Figure 2:
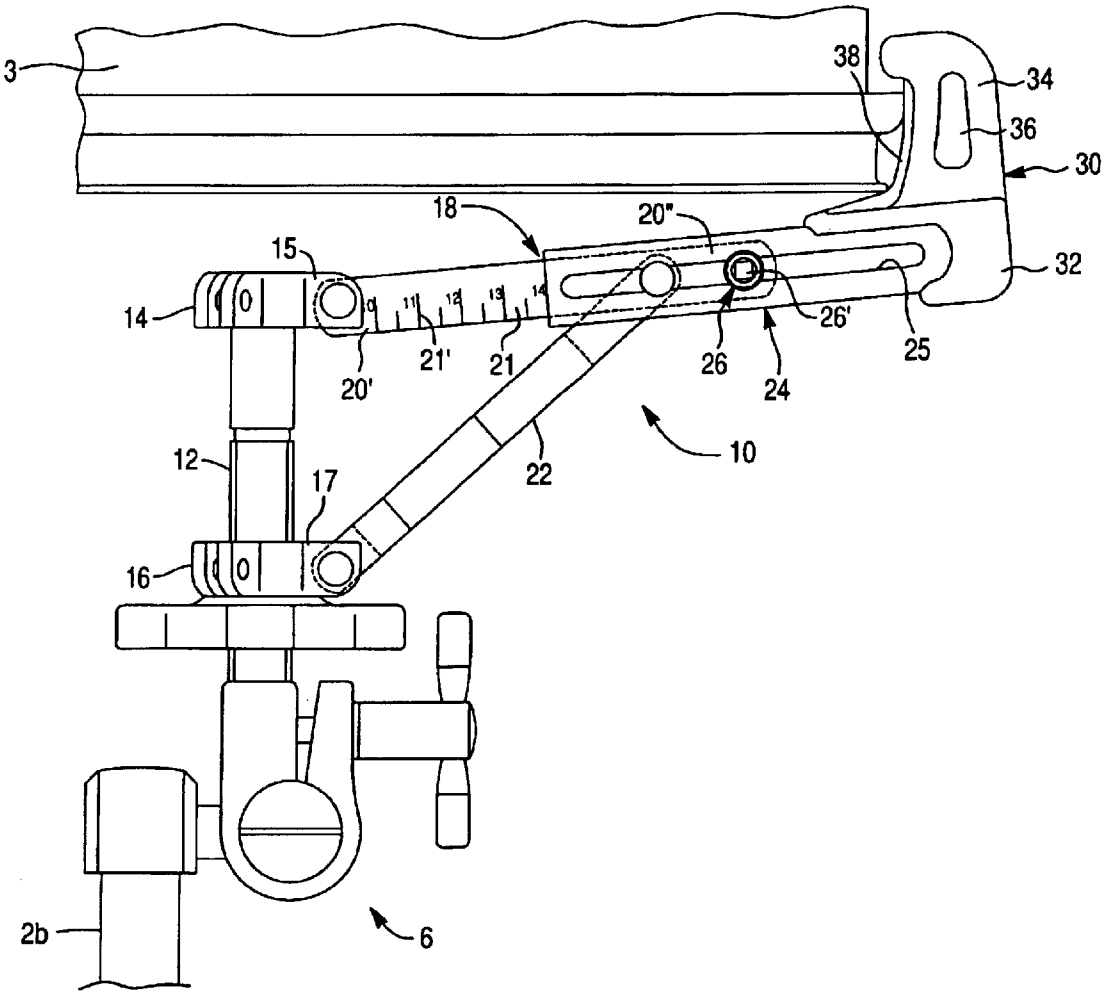
FIG. 2 is an enlarged elevation view of a drum holder assembly in accordance with the preferred embodiment of the present invention.

As illustrated in detail in FIG. 2, the drum holder assembly 10 includes the holder shaft 12 provided with a top head 14 secured to an upper end of the holder shaft 12, and a base head 16 slidable along a lower end portion of the holder shaft 12. At least three spaced radial arms 18 having an adjustable length are pivotally mounted to the top head 14 and extend substantially radially outwardly from the top head 14 acting as a common point for the radial arms 18. Each of the radial arms 18 includes a support member 20, and an adjustable sleeve member 24.

Each of the support members 20 is pivotally mounted to the top head 14 through lugs 15 at an inward end 20' thereof. Respective levers 22 are pivotally mounted to the base head 16 through lugs 17 at one ends thereof, and to the support members 20 at the other ends thereof.

Figure 3B:
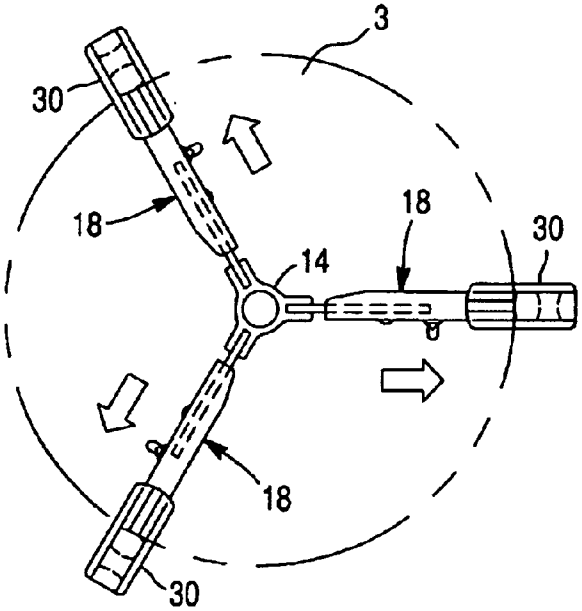
FIG. 3*b* is a top plan view of the drum holder assembly shown in FIG. 2 used in combination with a small diameter drum.
Figure 3A:
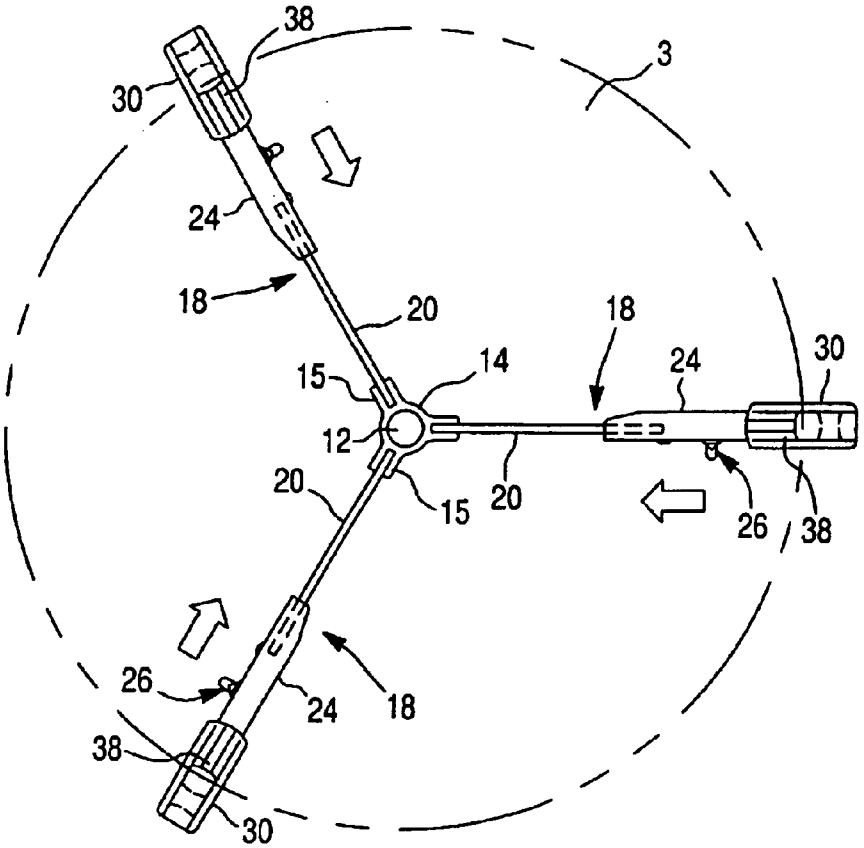
FIG. 3*a* is a top plan view of the drum holder assembly shown in FIG. 2 used in combination with a large diameter drum.

The adjustable sleeve member 24 is slidably mounted to a distal end portion 20" of the each of the support members 20 for adjusting an effective length of the radial arms 18 in order to accommodate drums of various sizes. More specifically, as illustrated in detail in FIG. 2, the sleeve members 24 are slidably mounted about the distal end portion 20" of the support members 20 for axial movement along a length thereof, as illustrated in FIGS. 3*a* and 3*b*. Particularly, FIG. 3*a* illustrates the top plan view of the drum holder assembly 10 with the radial arms 18 in their outermost extended position adapted to support the large diameter drums, while FIG. 3*b* illustrates the top plan view of the drum holder assembly 10 with the radial arms 18 in their innermost retracted position adapted to support the small diameter drums.

The sleeve member 24 is provided with a slot 25 therealong. The drum holder assembly 10 further includes a clamp device 26 adapted to secure the sleeve member 24 in a selected position relative to the support member 20. Preferably, the clamp device 26 includes a bolt 26' extending through the slot 25 in the sleeve member 24 and threadedly engaging a threaded hole at the distal end portion 20" of the support member 20 for clamping the sleeve member 24 to the support member 20.

Moreover, at least one of the radial arms 18 is provided with a plurality of marks 21' located on at least one of vertical surfaces 21 of the support members 20 to indicate the effective length of the respective radial arm 18. The marks 21' are disclosed to be in the form of raised ridges or grooves.

Each of the adjustable sleeve members 24 is provided at its distal end with a vibration-isolating member 30 adapted to engage an outer cylindrical surface of the drum 3, as illustrated in FIG. 2, and to effectively isolate vibrations emanating from the drum 3 during performance.

Preferably, the vibration-isolating member 30 has a solid unitary body including a base portion 32 and a grip portion 34 extending substantially vertically from the base portion 32. The base portion 32 is fixed to the distal end of each of the adjustable sleeve members 24 in any appropriate manner known to those skilled in the art. The grip portion 34 of the vibration-isolating member 30 has a hollow portion 36 formed therethrough so that the unitary body of the grip member 30 continuously circumscribes the hollow portion 36.

The presence of the hollow portion 36 allows the grip portion 34 of the vibration-isolating member 30 to deform when vibrations or other loads are transmitted to the radial arm 18 through the grip member 30 from the drum 3. In the preferred embodiment the hollow portion 36 is substantially vertically elongated, ovular through opening (or channel). Consequently, the grip portion 34 of the vibration-isolating member 30 extends substantially vertically from the base portion 32 and has a substantially toroidal shape elongated in a vertical direction.

A plurality of elastic ribs (or corrugations) 38 are formed on an outer surface of the vibration-isolating member 30 engaging the drum 3 to inhibit the drum 3 from slipping when placed on the vibration-isolating member 30. Preferably, the ribs 38 are provided on both the base portion 32 and the grip portion 34 of the vibration-isolating member 30, as illustrated in FIGS. 2, 3*a* and 3*b*. The ribs 38 inhibit the drum 3 from slipping relative to the radial arms 18.

When vibrations or other loads are transmitted to the vibration-isolating member 30 from the drum 3, the arcuate shaped grip portion 34 deforms and flattens, thereby absorbing the load.

In the preferred embodiment, the vibration-isolating member 30 is used to isolate vibrations emanating from the musical drum 3. FIG. 2 represents such an arrangement. The drum 3 is supported on the support stand 1 having a plurality of legs 4.

The musical drums all suffer from the common drawback that vibrations emanating from the drum head are transferred from the drum shell to the supporting legs and finally to the floor. This transfer of energy shortens the sustain of the drum and causes the drum to sound constricted. Placing the vibration-isolating member 30 between the drum 3 and the radial arms 18 effectively isolates the drum 3 from the radial arms 18, thereby substantially improving quality of sound of the drum 3 and increasing the drum's sustain.

The vibration-isolating member 30 is preferably made of a soft elastomeric material. The combination of a soft elastomeric material and the hollow portion 36 of the vibration-isolating member 30 has been shown to improve the performance of musical drums. The vibration-isolating member 30 is also preferably homogeneously formed as a unitary body, thus alleviating the cost of assembling multiple components and simplifying its manufacture.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A drum stand comprising:

an upright post; and a drum holder assembly including:

a plurality of radial arms extending substantially radially outwardly from a common point for holding said drum; and a vibration-isolating member provided at a distal end of each of said radial arms to firmly engage said drum and effectively isolate vibrations generated by said drum during performance, wherein said vibration-isolating member comprises a solid unitary body formed of elastomeric material having a base portion fixed to a distal end of each of said radial arm and a grip portion extending from said base portion and adapted to engage a musical drum, said grip portion having a hollow portion so that said unitary body continuously circumscribes said hollow portion.

2. The drum stand as defined in claim 1, wherein a plurality of corrugations are formed on an exterior surface of said vibration-isolating member to inhibit said drum from slipping with respect to said vibration-isolating member.

3. The drum stand as defined in claim 1, wherein said hollow portion comprises a substantially ovular channel extending through said solid unitary body.

4. The drum stand as defined in claim 3, wherein said ovular channel extends in a substantially vertical direction.

5. The drum stand as defined in claim 1, wherein said hollow portion is an opening extending completely through said solid unitary body thereby defining a substantially toroidal grip portion of said unitary solid body elongated in a vertical direction.

6. The drum stand as defined in claim 1, wherein said grip portion extends from said base portion in a substantially vertical direction.

7. The drum stand as defined in claim 1, further including a support connected to a lower end of said upright post for supporting said post on a floor.

8. A drum stand for supporting a drum, said drum stand comprising:

an upright post; and a drum holder assembly mounted to said upright post, said drum holder assembly including a plurality of radial arms extending substantially radially outwardly from a common point for holding said drum;

wherein each of said radial arms includes a support member pivotally mounted to said common point and an adjustable sleeve member slidably mounted about said support member.

9. The drum stand as defined in claim 8, further including a support connected to a lower end of said upright post for supporting said post on a floor.

10. The drum stand as defined in claim 9, wherein said support includes a tripod.

11. The drum stand as defined in claim 8, further including a drum holder adjusting device for angularly adjusting a position of said drum holder assembly relative to said upright post.

12. The drum stand as defined in claim 8, wherein said drum holder assembly further includes levers each pivotally mounted to said holder shaft at one end thereof and to corresponding one of said support members at the other end thereof.

13. The drum stand as defined in claim 8, wherein said support member of at least one of said radial arms is provided with a plurality of marks to indicate an effective length of said least one radial arm.

14. The drum stand as defined in claim 13, wherein said plurality of marks is in the form of one of raised ridges and grooves.

15. The drum stand as defined in claim 8, further including a grip member provided at a distal end of each of said radial arms to firmly engage said drum.

16. The drum stand as defined in claim 15, wherein said grip member is provided for effectively isolating vibrations generated by said drum during performance and comprises a solid unitary body formed of elastomeric material having a base portion fixed to a distal end of each of said radial arm and a grip portion extending from said base portion and adapted to engage said drum, said grip portion having a hollow portion so that said unitary body continuously circumscribes said hollow portion.

17. The drum stand as defined in claim 16, wherein a plurality of corrugations are formed on an exterior surface of said vibration-isolating member to inhibit said drum from slipping with respect to said vibration-isolating member.

18. The drum stand as defined in claim 16, wherein said hollow portion comprises a substantially ovular channel extending through said solid unitary body.

19. The drum stand as defined in claim 18, wherein said ovular channel extends in a substantially vertical direction.

20. The drum stand as defined in claim 16, wherein said hollow portion is an opening extending completely through said solid unitary body thereby defining a substantially toroidal grip portion of said unitary solid body elongated in a vertical direction.

21. The drum stand as defined in claim 16, wherein said grip portion extends from said base portion in a substantially vertical direction.

22. The drum stand as defined in claim 1, wherein said hollow portion is a through whole extending completely through said solid unitary body thereby defining a substantially annular solid body portion of said unitary solid body.

23. A drum stand comprising:

an upright post; and a drum holder assembly including:

a plurality of radial arms extending substantially radially outwardly from a common point for holding said drum; and a vibration-isolating member provided at a distal end of each of said radial arms to firmly engage said drum and effectively isolate vibrations generated by said drum during performance, wherein said vibration-isolating member comprises a solid unitary body formed of elastomeric material having a base portion fixed to a distal end of each of said radial arm and a grip portion extending from said base portion and adapted to engage a musical drum, said grip portion having a hollowed channel extending completely through said solid unitary body so as to define a continuously formed substantially annular solid portion.

* * * * *